US009536694B2

(12) United States Patent
Gottschalk et al.

(10) Patent No.: US 9,536,694 B2
(45) Date of Patent: Jan. 3, 2017

(54) ELECTRICAL SWITCHING APPARATUS AND POLE SHAFT CATCH ASSEMBLY THEREFOR

(71) Applicant: EATON CORPORATION, Cleveland, OH (US)

(72) Inventors: Andrew L. Gottschalk, Monaca, PA (US); Paul R. Rakus, Beaver Falls, PA (US); Erik R. Bogdon, Carnegie, PA (US)

(73) Assignee: EATON CORPORATION, Cleveland, OH (US)

( * ) Notice: Subject to any disclaimer, the term of this patent is extended or adjusted under 35 U.S.C. 154(b) by 91 days.

(21) Appl. No.: 14/560,191

(22) Filed: Dec. 4, 2014

(65) Prior Publication Data

US 2016/0163489 A1 Jun. 9, 2016

(51) Int. Cl.

| | |
|---|---|
| ***H01H 71/50*** | (2006.01) |
| ***H01H 3/32*** | (2006.01) |
| ***H01H 71/10*** | (2006.01) |

(52) U.S. Cl.

CPC ..... *H01H 71/505* (2013.01); *H01H 3/32* (2013.01); *H01H 71/10* (2013.01); *H01H 71/504* (2013.01)

(58) Field of Classification Search

CPC ..... H01H 71/10; H01H 71/505; H01H 3/32

USPC ..... 200/318, 39 R, 337, 400–401, 244, 250

See application file for complete search history.

(56) References Cited

U.S. PATENT DOCUMENTS

| | | | | |
|---|---|---|---|---|
| 4,491,709 | A * | 1/1985 | Chabot | H01H 3/3021 200/288 |
| 5,743,385 | A | 4/1998 | Godesa | |
| 6,008,459 | A * | 12/1999 | Faber | H01H 71/16 200/303 |
| 7,342,474 | B2 * | 3/2008 | Castonguay | H01H 89/08 200/400 |
| 7,459,650 | B2 | 12/2008 | Weister et al. | |

(Continued)

FOREIGN PATENT DOCUMENTS

| | | |
|---|---|---|
| CN | 102 054 631 A | 5/2011 |
| DE | 100 49 728 A1 | 4/2002 |
| EP | 2 228 810 A2 | 9/2010 |

OTHER PUBLICATIONS

European Patent Office, International Search Report and Written Opinion (for corresponding application PCT/US2015/056359), Jan. 22, 2016, 12 pp.

*Primary Examiner* — Edwin A. Leon

(74) *Attorney, Agent, or Firm* — Eckert Seamans; Grant Coffield

(57) ABSTRACT

A pole shaft catch assembly is for an electrical switching apparatus, such as a circuit breaker. The circuit breaker includes a housing, separable contacts enclosed by the housing, and an operating mechanism for opening and closing the separable contacts. The operating mechanism includes a pole shaft pivotably coupled to the housing and a yoke assembly coupled to the pole shaft. The pole shaft catch assembly includes a catch arm. The catch arm moves between an engaged position in which the catch arm engages the yoke assembly to restrict movement of the yoke assembly and the pole shaft, and a disengaged position in which the catch arm disengages the yoke assembly. A biasing element biases the catch arm toward the disengaged position. A trigger translates movement of the yoke assembly into movement of the catch arm.

14 Claims, 6 Drawing Sheets

(56) References Cited

U.S. PATENT DOCUMENTS

| | | | |
|---|---|---|---|
| 7,518,074 | B2 | 4/2009 | Weister et al. |
| 7,646,270 | B2 | 1/2010 | Spitsberg et al. |
| 2004/0134764 | A1 | 7/2004 | Bach et al. |
| 2008/0083600 | A1 | 4/2008 | Godesa |

* cited by examiner

ELECTRICAL SWITCHING APPARATUS AND POLE SHAFT CATCH ASSEMBLY THEREFOR

BACKGROUND

Field

The disclosed concept relates generally to electrical switching apparatus and, more particularly, to electric switching apparatus, such as for example, circuit breakers. The disclosed concept also relates to pole shaft catch assemblies for circuit breakers.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such a fault condition.

Some molded case circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. The pole shaft has a tendency to rebound (e.g., rotate backwards) in response to a relatively high current interruption. It is desirable to prevent such rebounding. There are, however, a number of unique design challenges to incorporating a suitable mechanism for preventing such rebounding. For example, in some molded case circuit breakers there is very little available space near the pole shaft.

There is, therefore, room for improvement in electrical switching apparatus, and in pole shaft catch assemblies therefor.

SUMMARY

These needs and others are met by embodiments of the disclosed concept, which are directed to a pole shaft catch assembly for electrical switching apparatus, such as circuit breakers.

As one aspect of the disclosed concept, a pole shaft catch assembly is provided for an electrical switching apparatus. The electrical apparatus comprises a housing, separable contacts enclosed by the housing, and an operating mechanism for opening and closing the separable contacts. The operating mechanism includes a pole shaft pivotably coupled to the housing and a yoke assembly coupled to the pole shaft. The pole shaft catch assembly comprises: a catch arm structured to cooperate with the yoke assembly, the catch arm moving between an engaged position in which the catch arm engages the yoke assembly to restrict movement of the yoke assembly and the pole shaft, and a disengaged position in which the catch arm disengages the yoke assembly; a biasing element biasing the catch arm toward the disengaged position; and a trigger cooperating with the catch arm, the trigger being structured to translate movement of the yoke assembly into movement of the catch arm.

As another aspect of the disclosed concept, an electrical switching apparatus comprises: a housing; separable contacts enclosed by the housing; an operating mechanism for opening and closing the separable contacts, the operating mechanism including a pole shaft pivotably coupled to the housing and a yoke assembly coupled to the pole shaft; and a pole shaft catch assembly comprising: a catch arm cooperating with the yoke assembly, the catch arm moving between an engaged position in which the catch arm engages the yoke assembly to restrict movement of the yoke assembly and the pole shaft, and a disengaged position in which the catch arm disengages the yoke assembly, a biasing element biasing the catch arm toward the disengaged position, and a trigger cooperating with the catch arm, the trigger being structured to translate movement of the yoke assembly into movement of the catch arm.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
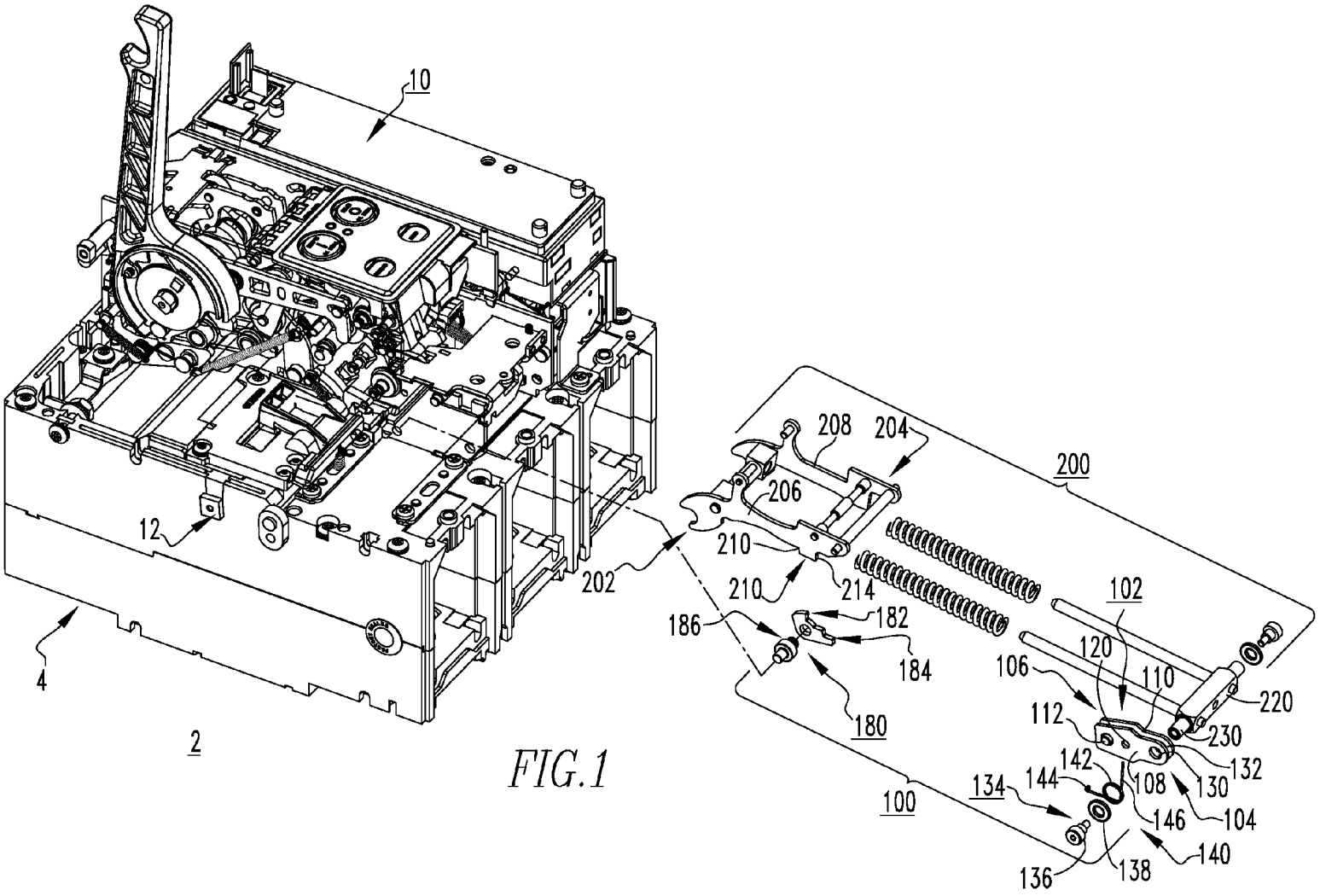
FIG. 1 is a partially exploded isometric view of a circuit breaker and pole shaft catch assembly therefor, in accordance with an embodiment of the disclosed concept.

For purposes of illustration, embodiments of the disclosed concept will be shown and described as applied to low-voltage molded case circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage molded case circuit breakers and other than low-voltage electrical switching apparatus.

Directional phrases used herein, such as, for example, left, right, clockwise, counterclockwise, top, bottom and derivatives thereof, relate to the orientation of the elements shown in the drawings and are not limiting upon the claims unless expressly recited therein.

As employed herein, the terms "yoke" and "yoke assembly" refer to any known or suitable component or assembly, respectively, that is structured to facilitate movement of the pole shaft of an electrical switching apparatus, for example, in order to open, close, or trip open the separable electrical contacts of the electrical switching apparatus, as desired.

As employed herein, the terms "fastener" and "fastener assembly" refer to any known or suitable element or elements which is/are employed to connect, fasten, secure or tighten two or more components together, and expressly includes, without limitation, rivets, pins, screws, bolts and suitable combinations of bolts, washers and nuts (e.g., without limitation, lock nuts).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
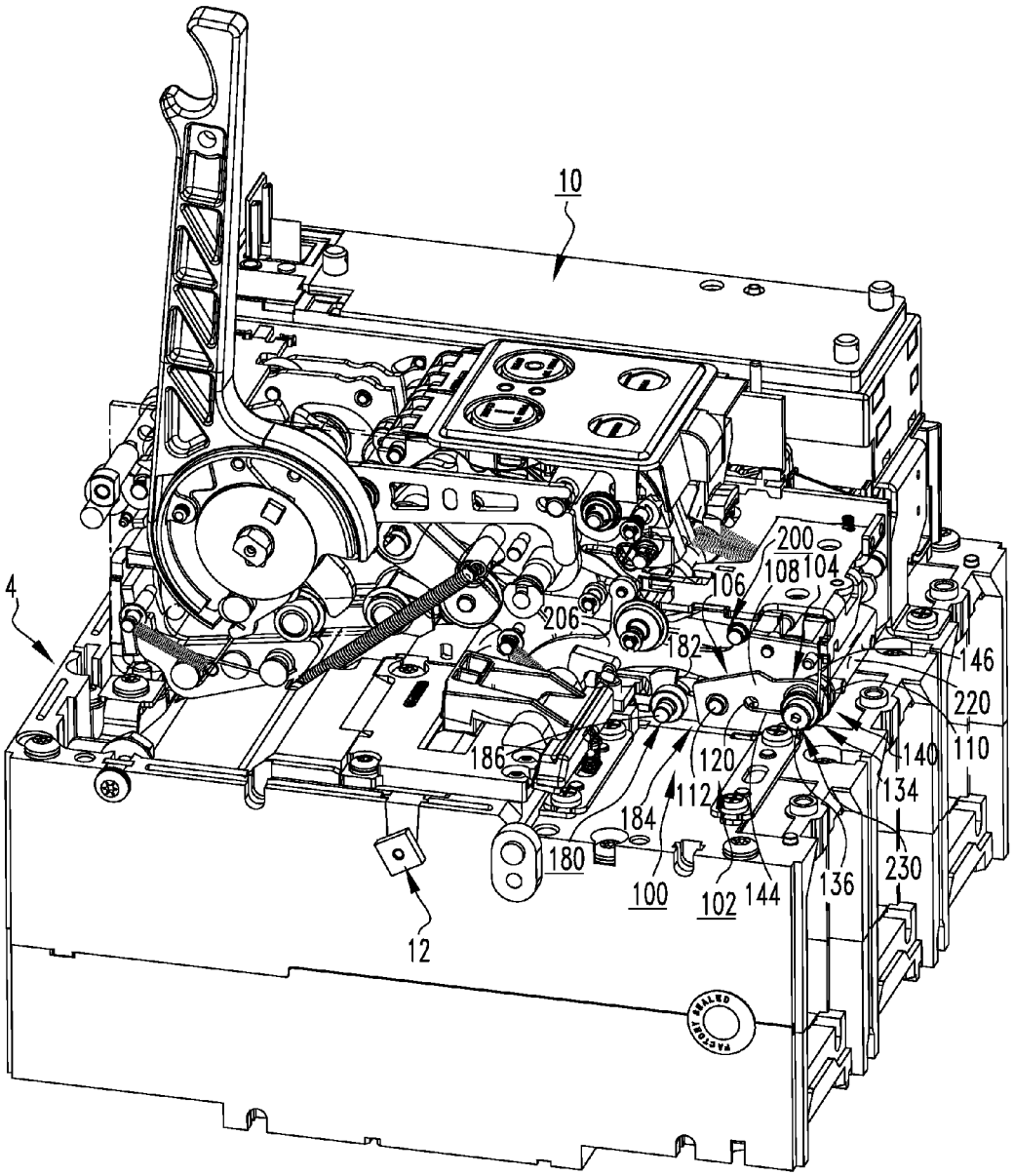
FIG. 2 is an assembled isometric view of the circuit breaker and pole shaft catch assembly therefor of FIG. 1, shown in the closed and discharged position.

FIGS. 1 and 2 show an electrical switching apparatus such as, for example, a low-voltage circuit breaker 2, and a pole shaft catch assembly 100 (shown in exploded view in FIG. 1) therefor. The circuit breaker 2 includes a housing 4, separable contacts (see, for example, stationary contact 6 and movable contact 8, both shown in FIGS. 4-8) enclosed by the housing 4 and an operating mechanism 10 for opening and closing the separable contacts 6,8. The operating mechanism 10 includes a pole shaft 12 (best shown in FIGS. 4-8), which is pivotably coupled to the housing 4, and a yoke assembly 200, which is coupled to the pole shaft 12.

The pole shaft 12 and yoke assembly 200 coupled thereto are movable among a first position (FIGS. 2 and 4) corresponding to the separable contacts 6,8 (FIG. 4) being closed, and a second position (FIGS. 5-8) corresponding to the separable contacts 6,8 being open. As best shown in the exploded view of FIG. 1, the example yoke assembly 200 includes a first end 202, which is coupled to the pole shaft 12 and, indirectly by way of the toggle assembly 20 (FIGS. 4-8) to the separable contacts 6,8 (FIGS. 4-8), and a second end 204 disposed opposite and distal from the first end 202. A first side 206 extends from the first end 202 toward the second end 204, and a second side 208 is disposed opposite the first side 206. A protrusion 210 protrudes from the first side 206, and includes a first edge 212 and a second edge 214. The yoke assembly 200 shown and described herein further includes a spring seat 220 disposed at or about the second end 204. It will, however, be appreciated that the yoke assembly 200 and individual components (e.g., without limitation, sides 206,208; spring seat 220) could comprise any known or suitable alternative configuration (not shown), without departing from the scope of the disclosed concept.

Figure 3A:
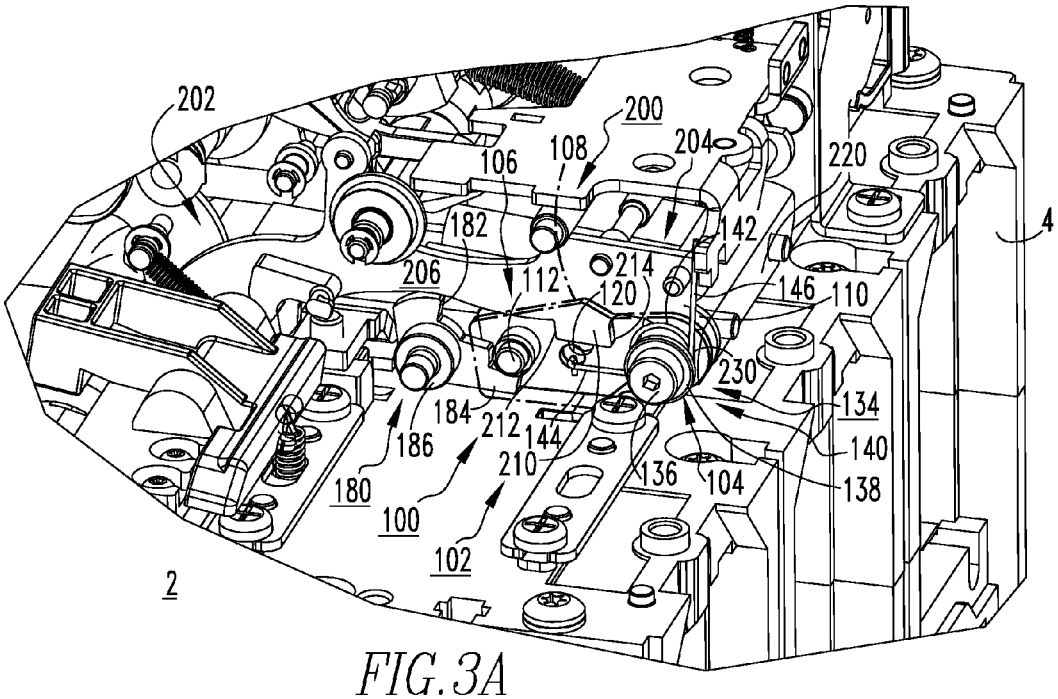
FIG. 3A is an enlarged isometric view of a portion of the circuit breaker and pole shaft catch assembly therefor of FIG. 2.
Figure 3B:
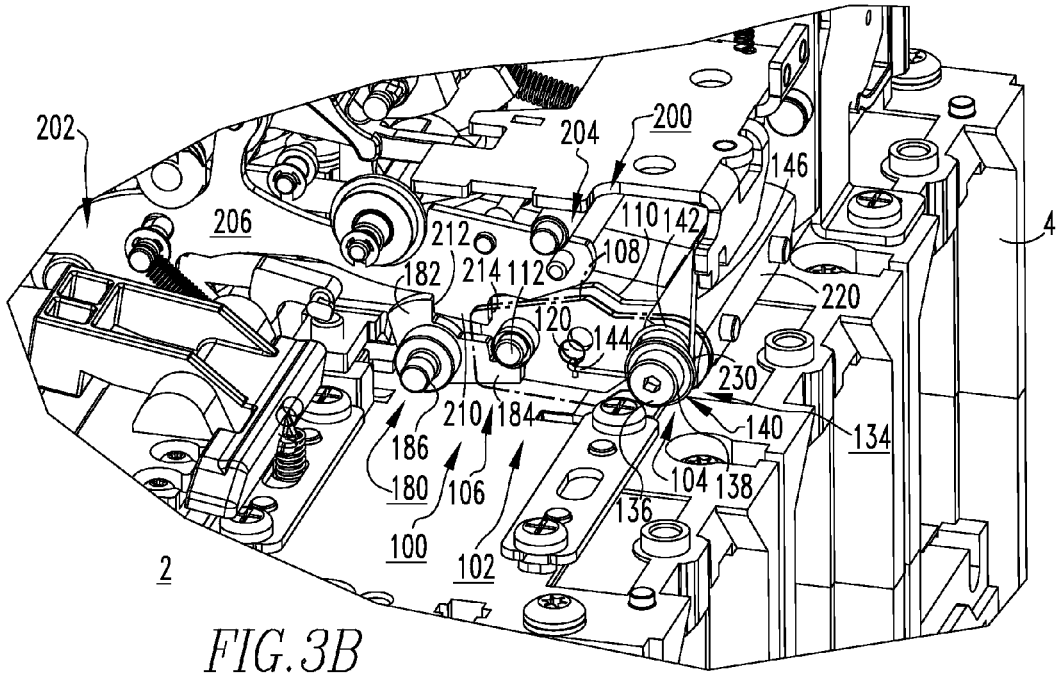
FIG. 3B is an enlarged isometric view of the portion of the circuit breaker and pole shaft catch assembly therefor of FIG. 3A, modified to show the pole shaft catch assembly corresponding to the circuit breaker being open and discharged.
Figure 4:
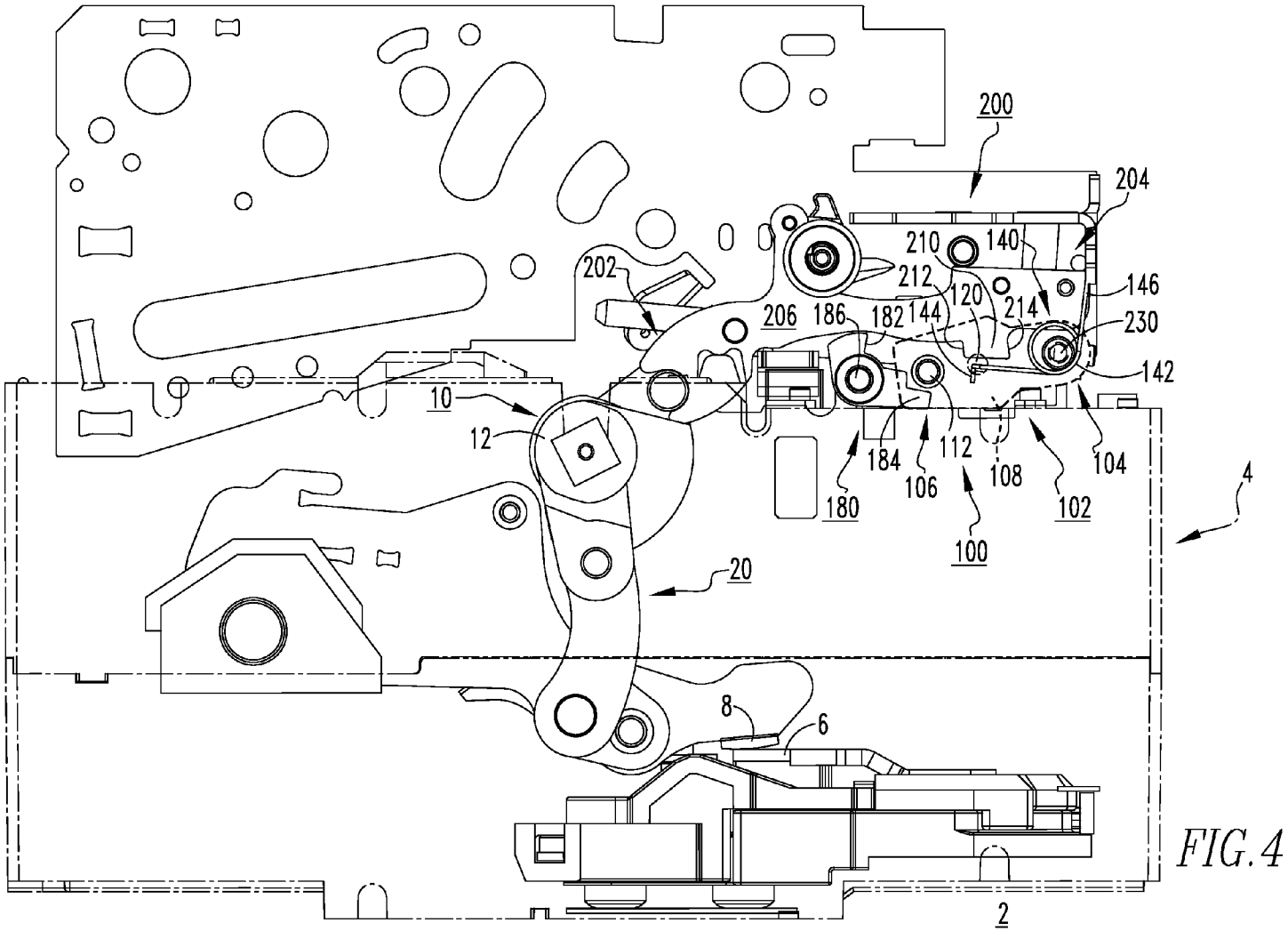
FIG. 4 is a side elevation view the circuit breaker and pole shaft catch assembly therefor of FIG. 2, shown in the closed position.
Figure 5:
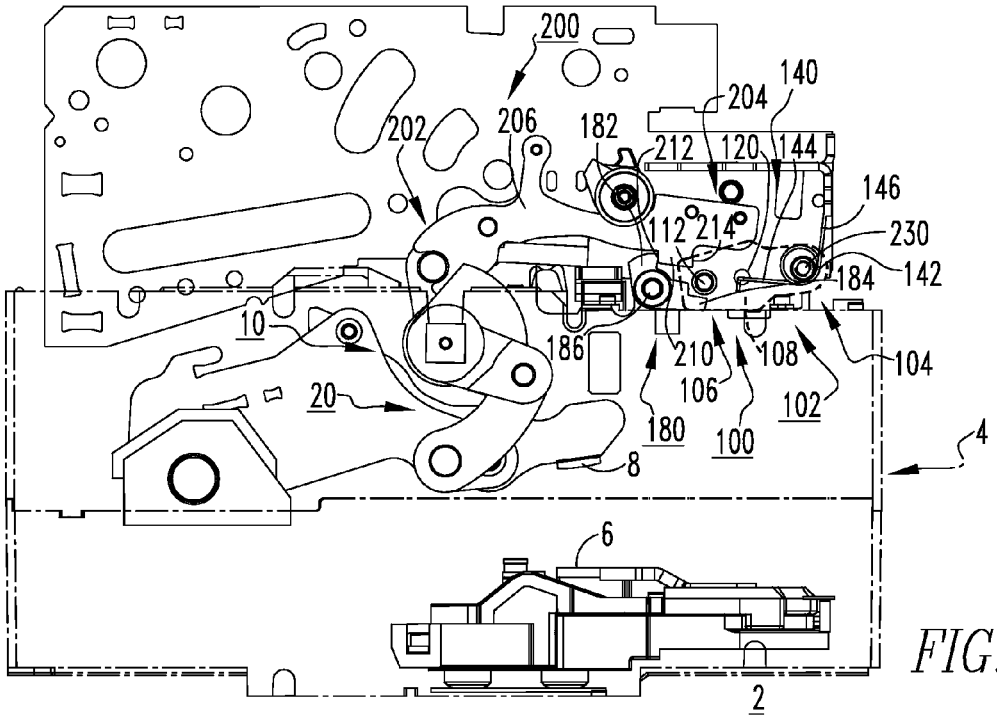
FIG. 5 is a side elevation view of the circuit breaker and pole shaft catch assembly therefor of FIG. 4, shown in a partially open position.
Figure 6:
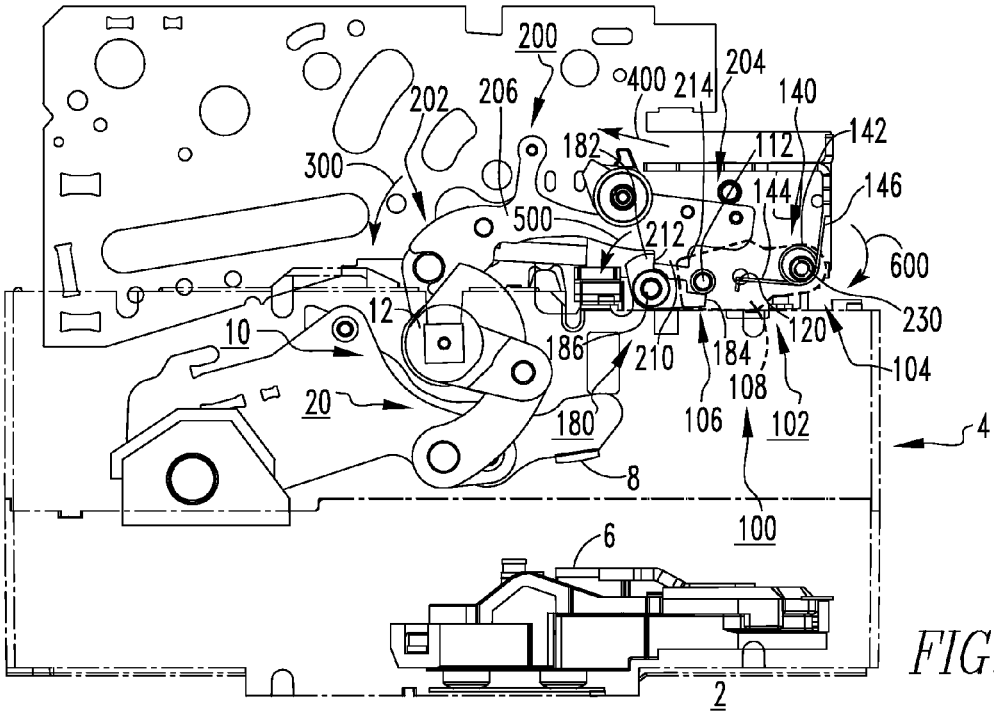
FIG. 6 is a side elevation view of the circuit breaker and pole shaft catch assembly therefor of FIG. 5, shown in the open position.

Continuing to refer to FIGS. 1 and 2, and also to FIGS. 3A and 3B, it will be appreciated that the example pole shaft catch assembly 100 includes a catch arm 102. The catch arm 102 is structured to cooperate with the yoke assembly 200, as will be described in greater detail herein. Specifically, the catch arm 102 is movable between an engaged position, shown for example in FIGS. 7 and 8, in which the catch arm 102 engages the yoke assembly 200 to restrict movement of the yoke assembly 200 and pole shaft 12 coupled thereto, and a disengaged position, shown in FIGS. 2, 3A, 3B and 4-6, in which the catch arm 102 disengages the yoke assembly 200, thereby permitting movement of the yoke assembly 200 and pole shaft 12. A biasing element, which in the example shown and described herein is a torsion spring 140, biases the catch arm 102 toward the disengaged position (FIGS. 2-6). A trigger 180 cooperates with the catch arm 102 and yoke assembly 200 to effectuate the desire movement during operation of the catch arm 102. In other words, the trigger 180 is structured to translate movement of the yoke assembly 200 into movement of the catch arm 102, as we described in greater detail herein with respect to FIGS. 4-8.

Figure 7:
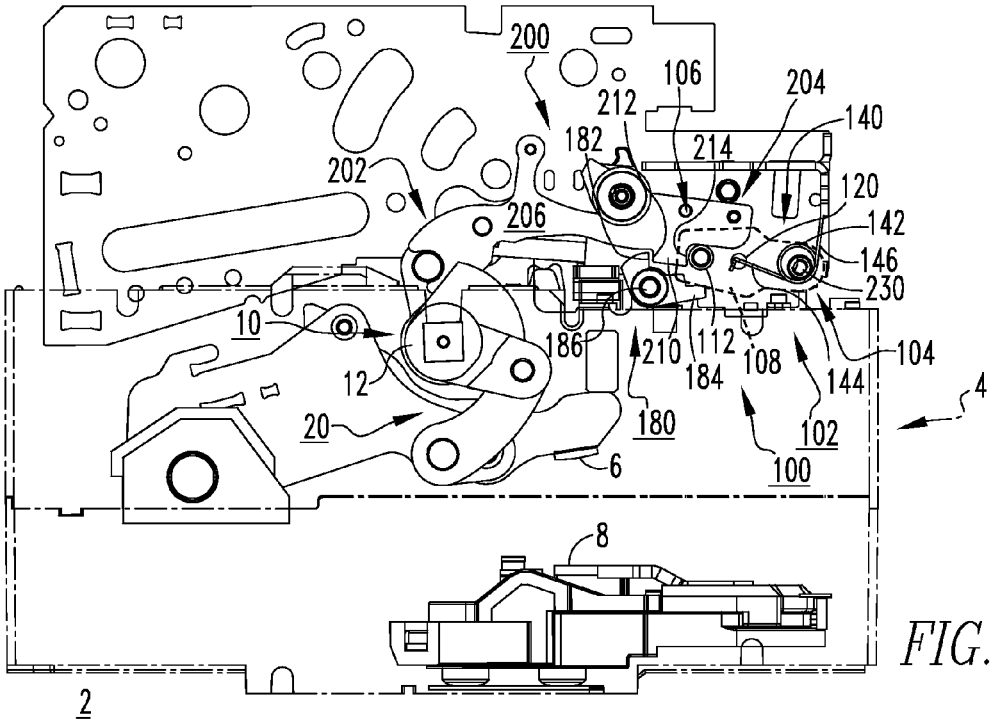
FIG. 7 is a side elevation view of the circuit breaker and pole shaft catch assembly therefor of FIG. 6, shown in the open position with the catch arm disposed in the engaged position.
Figure 8:
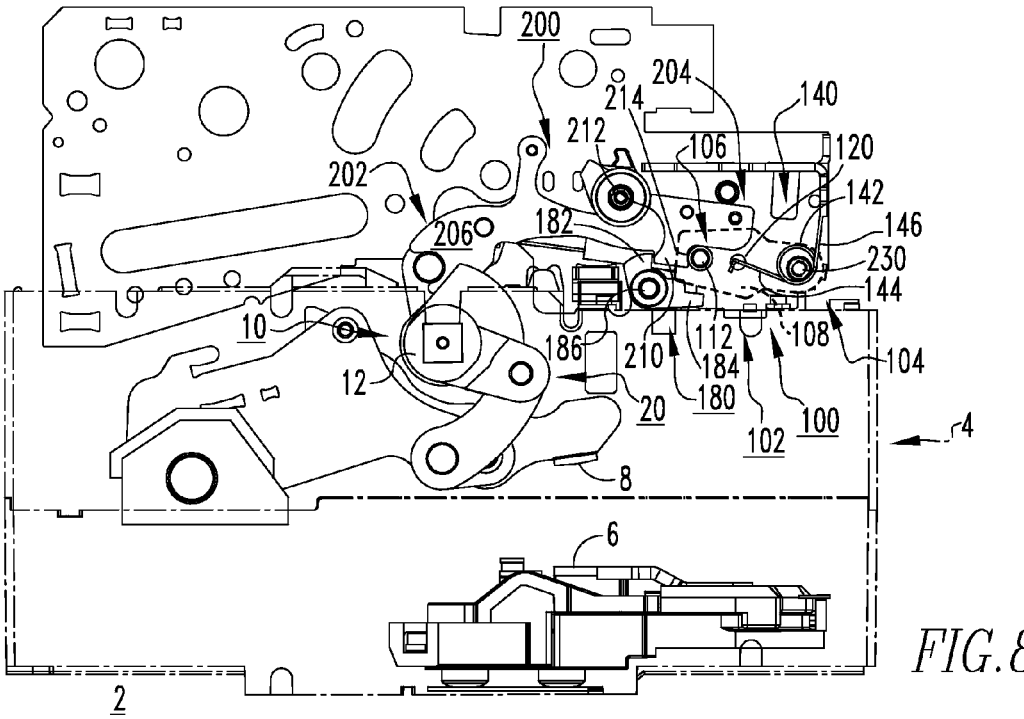
FIG. 8 is a side elevation view of the circuit breaker and pole shaft catch assembly therefor of FIG. 7, shown in the open position with the catch arm restricting movement of the yoke assembly.

As best shown in FIG. 1, the catch arm 102 of the example pole shaft catch assembly 100 includes a mounting portion 104 and a catch portion 106 disposed opposite and distal from the mounting portion 104. The mounting portion 104 is pivotably coupled to the yoke assembly 200 and, in particular, to a pivot portion 230 of the aforementioned spring seat 220, although it will be appreciated that it could be mounted in any known or suitable alternative manner (not shown), without departing from the scope of the disclosed concept. The aforementioned trigger 180 engages the catch portion 106, as shown for example in the enlarged views of FIGS. 3A and 3B, to move the catch arm 102 toward the engaged position (FIGS. 7 and 8). The catch arm 102 includes first and second planar members 108,110, which are disposed opposite and spaced apart from one another. A cross member, which in the example shown and described herein is a catch pin 112, extends between the first and second planar members 108,110 at or about the catch portion 106 of the catch arm 102. It will be appreciated, therefore, that portions of the yoke assembly 200 and trigger 180 extend into the catch arm 102. That is, they extend between the first and second opposing planar members 108,110 (see, for example, protrusion 210 of yoke assembly side 206 and trigger portion 184 of trigger 180, shown behind first planar member 208, which is shown in phantom line drawing in FIGS. 3A and 3B).

The trigger 180 preferably includes an actuation portion 182 and a trigger portion 184. The actuation portion 182 is structured to be engaged by the first edge 212 of the protrusion 210, which extends from the first side 206 of the yoke assembly 200 (see, for example, FIGS. 5 and 6). Specifically, in operation, when the pole shaft 12 pivots (e.g., rotates counterclockwise in the direction of arrow 300 from the perspective of FIG. 6), the yoke assembly moves (e.g., to the left in the direction of arrow 400 from the perspective of FIG. 6), which causes the first edge 212 of the yoke assembly protrusion 210 to engage the actuation portion 182 of the trigger 180. In response, the trigger 180 pivots (e.g., rotates counterclockwise in the direction of arrow 500 from the perspective of FIG. 6) about the pivot member 186 causing the trigger portion 184 of the trigger 180 to engage the catch pin 112 of catch arm 102, thereby pivoting (e.g., rotating clockwise in the direction of arrow 600 from the perspective of FIG. 6) the catch arm 102. In other words, the trigger portion 184 extends between the first and second planar members 108,110, as best shown in FIGS. 3A and 3B, to engage the catch pin 112 and pivot (e.g., rotate clockwise in the direction of arrow 600 from the perspective of FIG. 6) the catch arm 102 toward the engaged position of FIGS. 7 and 8. In such engaged position (see FIGS. 7 and 8), the catch pin 112 is positioned to cooperate with the second edge 214 of the yoke assembly protrusion 210, thereby resisting the yoke assembly 200 and, in particular, the pole shaft 12 from undesirably rebounding (e.g., rotating clockwise from the perspective of FIGS. 7 and 8). Specifically, as shown in FIG. 8, the protrusion 210 and, in particular, second edge 214 thereof is engaging the catch pin 112 of the catch arm 102 between the first and second planar members 108,110 of the catch arm 102, in order to restrict (e.g., prevent) such undesirable rebounding motion.

Such operation of the example pole shaft catch assembly 100 will be further appreciated with reference to the sequential views of FIGS. 4-8, wherein the circuit breaker housing 4 is shown in phantom line drawing to illustrate the various positions of internal components during operation. More specifically, the inertia of the catch arm 102, when activated during a relatively high current interruption, overcomes the bias of the torsion spring 140 and travels beyond the distance where the yoke assembly 200 is in contact with it. This over-travel, which only occurs at higher currents (faster opening speed) moves (i.e., positions) the catch arm 102 in the engaged position, where it remains long enough to arrest a rebound, as shown in FIG. 8. The torsion spring 140 then resets the catch assembly 100 immediately after the rebound energy has dissipated, thereby allowing the circuit breaker 2 to close again.

Referring again to FIG. 1, and also to FIGS. 2-8, it will be appreciated that the first and second planar members 108, 110 of the catch arm 102 respectively include thru holes 130,132. The aforementioned pivot portion 230 of the spring seat 220 extends through the thru holes 130,132, as well as through the coils 142 of the torsion spring 140 (best shown in FIGS. 4-8). A first leg 144 of the torsion spring 140 engages the first planar member 108 at or about a spring aperture 120 thereof, and a second leg 146 of the torsion spring 140 engages a portion of the circuit breaker housing 4. Thus, it will be appreciated that the torsion spring 140 provides the aforementioned bias of the catch arm 102 toward the disengaged position of FIGS. 4-6.

As shown in FIGS. 1-3B, the catch arm 102 in the example shown and described herein, further includes a fastening assembly 134. Specifically, as best shown in FIG. 1, the fastener assembly 134 includes a bolt 136 and a washer 138. The bolt 136 extends through the washer 138 and the coils 142 of the torsion spring 140 to secure (e.g., fasten) the catch arm 102 to the spring seat 220.

Accordingly, it will be appreciated that the pole shaft catch assembly 100 of the disclosed concept provides an effective mechanism for resisting undesirable rebounding of the pole shaft 12, for example, after the circuit breaker 2 opens (see, for example, FIGS. 5-8) as a result of a relatively high current interruption. The pole shaft catch assembly 100 effectively achieves this objective using a unique catch arm 102 and trigger 180 arrangement to translate movement of the yoke assembly 200 into a desired corresponding movement of the catch arm 102. Thus, despite very limited space proximate the pole shaft 12, the disclosed pole shaft catch assembly 100 effectively resists undesirable or unintended rotation (e.g., rebounding) of the pole shaft 12.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A pole shaft catch assembly for an electrical switching apparatus, said electrical apparatus comprising a housing, separable contacts enclosed by the housing, and an operating mechanism for opening and closing said separable contacts, said operating mechanism including a pole shaft pivotably coupled to the housing and a yoke assembly coupled to said pole shaft, said pole shaft catch assembly comprising:

a catch arm structured to cooperate with said yoke assembly, said catch arm moving between an engaged position in which said catch arm engages said yoke assembly to restrict movement of said yoke assembly and said pole shaft, and a disengaged position in which said catch arm disengages said yoke assembly;

a biasing element biasing said catch arm toward said disengaged position; and a trigger cooperating with said catch arm, said trigger being structured to translate movement of said yoke assembly into movement of said catch arm, wherein said catch arm comprises a mounting portion and a catch portion disposed opposite and distal from said mounting portion; wherein said catch arm is structured to pivot about said mounting portion with respect to said yoke assembly; and wherein said trigger engages said catch portion to move said catch arm toward said engaged position, wherein said catch arm further comprises a first planar member, a second planar member, and a across member; wherein said second planar member is disposed opposite and spaced apart from said first planar member; and wherein said cross member extends between said first planar member and said second planar member at or about said catch portion, and wherein said trigger comprises an actuation portion and a trigger portion; wherein said actuation portion is structured to cooperate with said yoke assembly to pivot said trigger; wherein said trigger portion extends between said first planar member and said second planar member; and wherein, responsive to said yoke assembly pivoting said trigger, said trigger portion engages said cross member and pivots said catch arm toward said engaged position.

2. The pole shaft catch assembly of claim 1 wherein said trigger further comprises a pivot member structured to pivotably couple said trigger to the housing.

3. The pole shaft catch assembly of claim 1 wherein said yoke assembly comprises a first end coupled to said pole shaft, a second end disposed opposite and distal from the first end, a first side, a second side disposed opposite the first side, and a protrusion protruding from the first side; where said protrusion has a first edge and a second edge; and wherein the first edge of said protrusion is structured to engage said actuation portion of said trigger to pivot said trigger.

4. The pole shaft catch assembly of claim 3 wherein said cross member is a catch pin; wherein a portion of said protrusion is structured to extend between said first planar member and said second planar member; and wherein, when said catch arm is disposed in said engaged position, said catch pin is structured to engage the second edge of said protrusion to prevent said yoke assembly and said pole shaft from rebounding.

5. The pole shaft catch assembly of claim 4 wherein said yoke assembly further comprises a spring seat; wherein said spring seat includes a pivot portion; wherein said biasing element is a torsion spring having a number of coils, a first leg, and a second leg; wherein said first planar member of said catch arm includes a spring aperture; wherein said pivot portion of said spring seat extends through said number of coils; wherein said first leg engages said first planar member at or about said spring aperture; and wherein said second leg is structured to engage a portion of the housing.

6. The pole shaft catch assembly of claim 5 wherein said first planar member and said second planar member each include a thru hole; and wherein said pivot portion of said spring seat extends through said thru hole of said first planar member and said thru hole of said second planar member.

7. The pole shaft catch assembly of claim 5 wherein said catch arm further comprises a fastener assembly structured to fasten said torsion spring to said first planar member.

8. An electrical switching apparatus comprising:

a housing;

separable contacts enclosed by the housing;

an operating mechanism for opening and closing said separable contacts, said operating mechanism including a pole shaft pivotably coupled to the housing and a yoke assembly coupled to said pole shaft; and a pole shaft catch assembly comprising:

a catch arm cooperating with said yoke assembly, said catch arm moving between an engaged position in which said catch arm engages said yoke assembly to restrict movement of said yoke assembly and said pole shaft, and a disengaged position in which said catch arm disengages said yoke assembly, a biasing element biasing said catch arm toward said disengaged position, and a trigger cooperating with said catch arm, said trigger being structured to translate movement of said yoke assembly into movement of said catch arm, wherein said catch arm comprises a mounting portion and a catch portion disposed opposite and distal from said mounting portion; wherein said mounting portion is pivotably coupled to said yoke assembly; and wherein said trigger engages said catch portion to move said catch arm toward said engaged position, wherein said catch arm further comprises a first planar member, a second planar member, and a cross member; wherein said second planar member is disposed opposite and space apart from said first planar member; and wherein said cross member extends between said first planar member and said second planar member at or about said catch portion, and wherein said trigger comprises an actuation portion and a trigger portion; wherein said actuation portion cooperates with said yoke assembly to pivot said trigger; wherein said trigger portion extends between said first planar member and said second planar member; and wherein, responsive to said yoke assembly pivoting said trigger, said trigger portion engages said cross member and pivots said catch arm toward said engaged position.

9. The electrical switching apparatus of claim 8 wherein said trigger further comprises a pivot member pivotably coupling said trigger to the housing.

10. The electrical switching apparatus of claim 8 wherein said yoke assembly comprises a first end coupled to said pole shaft, a second end disposed opposite and distal from the first end, a first side, a second side disposed opposite the first side, and a protrusion protruding from the first side; where said protrusion has a first edge and a second edge; and wherein the first edge of said protrusion engages said actuation portion of said trigger to pivot said trigger.

11. The electrical switching apparatus of claim 10 wherein said cross member is a catch pin; wherein a portion of said protrusion extends between said first planar member and said second planar member; and wherein, when said catch arm is disposed in said engaged position, said catch pin engages the second edge of said protrusion to prevent said yoke assembly and said pole shaft from rebounding.

12. The electrical switching apparatus of claim 11 wherein said yoke assembly further comprises a spring seat; wherein said spring seat includes a pivot portion; wherein said biasing element is a torsion spring having a number of coils, a first leg, and a second leg; wherein said first planar member of said catch arm includes a spring aperture; wherein said pivot portion of said spring seat extends through said number of coils; wherein said first leg engages said first planar member at or about said spring aperture; and wherein said second leg engages a portion of the housing.

13. The electrical switching apparatus of claim 12 wherein said first planar member and said second planar member each include a thru hole; and wherein said pivot portion of said spring seat extends through said thru hole of said first planar member and said thru hole of said second planar member.

14. The electrical switching apparatus of claim 12 wherein said catch arm further comprises a fastener assembly fastening said torsion spring to said first planar member.

* * * * *